United States Patent [19]

Ritterman

[11] Patent Number: 4,883,380

[45] Date of Patent: Nov. 28, 1989

[54] LOTION APPLICATOR

[76] Inventor: Paul H. Ritterman, 5938 St. Mary's St., Baltimore, Md. 21207

[21] Appl. No.: 248,989

[22] Filed: Sep. 26, 1988

[51] Int. Cl.[4] ..... A45D 34/04

[52] U.S. Cl. ..... 401/208; 401/6; 401/219; 401/220

[58] Field of Search ..... 401/208, 219, 220, 21, 401/6

[56] References Cited

U.S. PATENT DOCUMENTS

| | | | |
|---|---|---|---|
| 1,405,059 | 1/1922 | Morgan | 401/219 X |
| 2,570,243 | 10/1951 | Johnson | 401/208 |
| 2,705,811 | 4/1955 | Moran | 401/21 X |
| 2,732,575 | 1/1956 | Faust | 401/220 |
| 2,829,393 | 4/1958 | Turcotte | 401/207 |
| 3,182,347 | 5/1965 | Haines | 401/220 |
| 3,807,881 | 4/1974 | Seidler | 401/175 |
| 4,050,826 | 9/1977 | Berghahn | 401/196 |
| 4,078,865 | 3/1978 | Moser | 401/23 |
| 4,150,904 | 4/1979 | Stewart | 401/208 X |
| 4,483,636 | 11/1984 | Meyer | 401/266 |

FOREIGN PATENT DOCUMENTS

| | | | |
|---|---|---|---|
| 208946 | 6/1908 | Fed. Rep. of Germany | 401/220 |
| 285147 | 5/1931 | Italy | 401/208 |
| 496670 | 12/1938 | United Kingdom | 401/220 |
| 680236 | 10/1952 | United Kingdom | 401/208 |

*Primary Examiner*—Steven A. Bratlie
*Attorney, Agent, or Firm*—Leon Gilden

[57] ABSTRACT

A lotion applicator is set forth wherein an elongate housing tapering outwardly includes a longitudinally positionable axle wherein a sponge-like applicator is secured thereto. A convex positioning member is fixedly secured to the axle and the sponge-like applicator for maintaining a convex configuration of the sponge-like material when in an extended position and withdrawing the sponge-like material interiorly of the housing when not in use whereby the pivotal handle is pivotably mounted to overlie the housing with a forwardly mounted cover for storage of the device.

1 Claim, 1 Drawing Sheet

LOTION APPLICATOR

BACKGROUND OF THE INVENTION

1. Field of the Invention

The field of invention relates to lotion applicators, and more particularly pertains to a new and improved lotion applicator wherein the same may be compactly stored when not in use and readily reoriented for operative employment thereof.

2. Description of the Prior Art

The use of lotion applicators is well known in the prior art. As can be appreciated, these devices have typically been of fixed configuration with respect to an applicator surface and have limited the use of such devices for compact storage applications. For example, U.S. Pat. No. 2,829,393 to Turcotte sets forth a lotion applicator with a fixed applicator head including a sponge-like portion with an elongate handle directed offset to the head. The patent is of interest relative to a typical lotion applicator apparatus.

U.S. Pat. No. 3,807,881 to Seidler sets forth a cosmetic tip applicator wherein a reservoir is displaced and communicates from applicator surface by an axial channel to provide a supply of cosmetic material between the applicator tip and the storage.

U.S. Pat. No. 4,050,826 to Berghahn sets forth an applicator wherein a hemispherical tip is fixedly secured relative to an outlet to enable a supply of fluid through the porous tip to a surface.

U.S. Pat. No. 4,078,865 to Moser sets forth an applicator surface with an elongate handle provided with a channel therethrough for receiving liquid from a replaceable bottle supply source. The Moser patent is again typical of fixed applicator surfaces.

U.S. Pat. No. 4,483,636 Meyer sets forth an applicator surface provided with an applicator head and a surface 30 enabling the flow of fluid therethrough wherein the head may be mounted in a ball and socket arrangement relative to the handle to provide a degree of accommodation of the head relative to the handle upon application to a human body.

As such, it may be appreciated there continues to be a need for a new and improved lotion applicator that may be compactly stored and may be readily and effectively extended for use.

SUMMARY OF THE INVENTION

In view of the foregoing disadvantages inherent in the known types of lotion applicators now present in the prior art, the present invention provides a lotion applicator wherein the same includes a pivotally mounted handle relative to an elongate body and a removable closure cap wherein the closure cap is removable and the pivotal handle is extended to a locked position to enable effective utilization of the apparatus. As such, the general purpose of the present invention, which will be described subsequently in greater detail, is to provide a new and improved lotion applicator which has all the advantages of the prior art lotion applicators and none of the disadvantages.

To attain this, the present invention comprises an outwardly tapered elongate housing wherein a pivotally mounted handle is secured relative to the housing by means of a closure cap and lockable in a second position when oriented outwardly of the housing with an applicator surface positionable in a first extended position to a second extracted position for storage thereof.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore and object of the present invention to provide a new and improved lotion applicator which has all the advantages of the prior art lotion applicators and none of the disadvantages.

It is another object of the present invention to provide a new and improved lotion applicator which may be easily and efficiently manufactured and marketed.

It is a further object of the present invention to provide a new and improved lotion applicator which is of a durable and reliable construction.

An even further object of the present invention is to provide a new and improved lotion applicator which is susceptible of a low cost of manufacture with regard to both materials and labor, and which accordingly is then susceptible of low prices of sale to the consuming public, thereby making such lotion applicator economically available to the buying public.

Still yet another object of the present invention is to provide a new and improved lotion applicator which provides in the apparatuses and methods of the prior art some of the advantages thereof, while simultaneously overcoming some of the disadvantages normally associated therewith.

Still another object of the present invention is to provide a new and improved lotion applicator wherein the same may be compactly stored during periods of non-use and extended for application of lotion to an individual.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
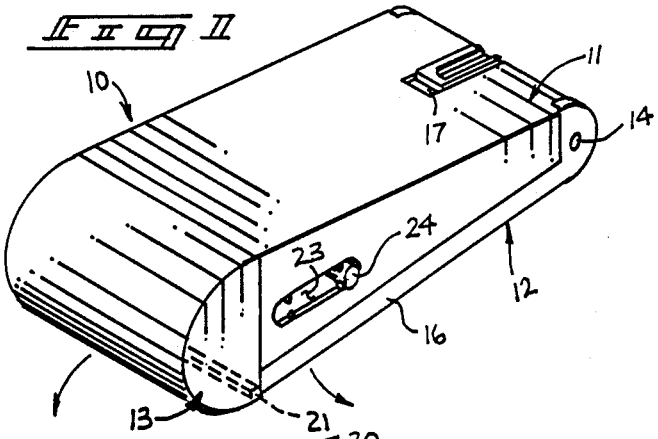
FIG. 1 is an isometric illustration of the instant invention.

With reference now to the drawings, and in particular to FIGS. 1 to 4 thereof, a new and improved lotion applicator embodying the principles and concepts of the present invention and generally designated by the reference numeral 10 will be described.

Figure 3:
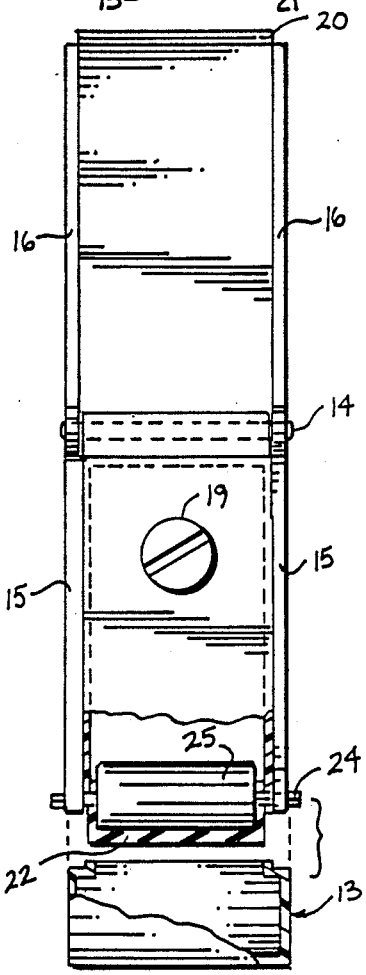
FIG. 3 is a top orthographic plan view illustrated partially in section of the instant invention.

More specifically, the lotion applicator apparatus 10 essentially comprises an elongate tapered housing 11 tapering from a rearward portion to a wider forward portion with a handle 12 pivotally mounted at the rear portion thereof by means of a pivot axle 14 extending along the entire width of the housing with a cover lid 13 frictionally secured to the housing at a forwardmost portion thereof. The handle 12 is formed with an elongate extending handle lip 16 extending orthogonally downwardly relative to the handle for mating interengagement with housing recesses 15 positioned on either side of the housing 11, as illustrated in FIG. 3.

Figure 2:
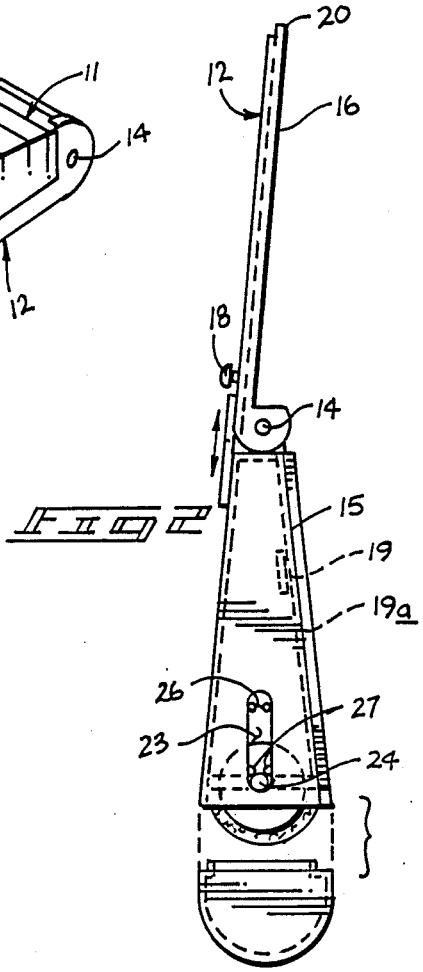
FIG. 2 is an orthographic side view of the instant invention illustrating the outwardly oriented handle and applicator surface.

Mounted on a surface of the housing opposite to that of the handle 12 is a sliding bifurcated latch member 17 slidably secured within the housing surface and engaging a mushroom shaped pin 18 positioned orthogonally outwardly relative to the handle 12 about which the bifurcated latch member 17 engages to maintain the handle 12 in an extended orientation, as illustrated in FIG. 2.

Upon latching the handle 12 in extended position, a reservoir plug 19 is exposed to enable introduction of lotion into the fluid reservoir 19*a* from interiorly of the housing 11.

The handle 12 is maintained in a closed orientation, as illustrated in FIG. 1, when a reduced thickness terminal tip 20 of the handle 12 extending outwardly of the end of the handle 12 is positionable within a recess 21 of the cap 13 to secure the handle against the housing body to provide a compact storable organization, as illustrated in FIG. 1.

A sponge-like applicator surface 22 is formed of a generally semi-cylindrical configuration sealingly about a forward portion of the housing 11 wherein applicator axle 24 is reciprocatable within an elongate slot 23 and the sponge-like applicator surface 22 is secured to the axle 24 by a hemispherical form member 25 to thereby enable the applicator surface 22 to linearly follow withdrawal of the axle 24 rearwardly into the slot 23. To this end, a plurality of opposed rearward detent projection 26 positioned within the applicator slot 23 maintains the axle 24 in a rearward locked positioned while a plurality of forward detent projections are formed proximate a forward end of the slot 23 to maintain the axle in a forward position. It is to be understood that the elongate slot 23 is formed on either side of the housing 11 in an aligned parallel orientation.

Figure 4:
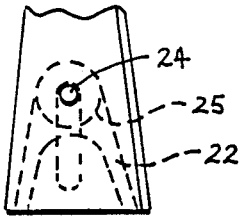
FIG. 4 is an orthographic side view of the instant invention illustrating the applicator surface in a retracted orientation relative to the housing.

Upon use of the lotion applicator apparatus 10, the lid 13 is removed from frictional interengagement with the housing 11 and thereby frees the handle 12 for rearward pivotal movement and enables latching of same by means of the bifurcated latch member 17, as illustrated in FIG. 2. Thereafter, the applicator axle 24 is forwardly positioned to interengage with the forward detent projections 27 to maintain the sponge-like applicator surface 22 in orientation, as illustrated in FIG. 2. Retraction of the sponge-like applicator surface 25 is accommodated within the housing, as illustrated in FIG. 4.

As to the manner of usage and operation of the instant invention, the same should be apparent from the above description and accordingly no further discussion relative to the manner of usage and operation will be provided.

With respect to the above description then, it is to be realized that the optimum dimensional relationship for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the Unites States is as follows:

1. A lotion applicator apparatus for application of fluid to a surface of the human body comprising, a housing means including a reservoir for replaceably storing a quantity of said fluid therein, and a handle means pivotally mounted to said housing means for movement from a first position adjacent to said housing means to an extended second position extending outwardly of said housing means, and latch means for securing said handle means in said extended second position, and a semi-cylindrical sponge-like applicator member selectively positionable in said housing means for dispensing fluid from said reservoir to the human body, and wherein said applicator member is reciprocatably mounted in said housing means and positionable from a first position retracted within said housing means to a second position extending outwardly of said housing means, and wherein said applicator member includes a hemispherical form member positioned interiorly of said applicator member and spaced and secured to an axle wherein said axle is mounted for manual grasping from said first position to said second position, and wherein said handle means includes a plurality of flanges orthogonally and integrally formed to sides of said handle means and nestable within recesses formed in said housing means, and wherein said handle means includes a reduced terminal tip extending outwardly of said handle means between said flanges and positionable within a recess formed within a cap lid, and said cap lid is frictionally securable to an end of said housing means remote from the pivotal mounting of said housing means for securement of said housing means and simultaneously securing said handle means in said first position, and wherein said axle extends outwardly of said housing means through either side thereof for manual grasping, and wherein said latch means is slidably mounted on said housing means and is bifurcated at a forward end for engaging a pin orthogonally directed outwardly of said handle means, and wherein said reservoir is accessible upon removal of a replaceable plug mounted within said housing means wherein said plug is underlying said handle means in said first position and exposed when said handle means is in said second position.

* * * * *